US010889013B2

(12) United States Patent
Scimone et al.

(10) Patent No.: US 10,889,013 B2
(45) Date of Patent: Jan. 12, 2021

(54) CUTTING DEVICE

(71) Applicant: Slice, Inc., San Jose, CA (US)

(72) Inventors: Thomas Scimone, Campbell, CA (US); Scot Herbst, Santa Cruz, CA (US); Robert Joseph Gallegos, Fremont, CA (US)

(73) Assignee: Slice, Inc., San Jose, CA (US)

( * ) Notice: Subject to any disclaimer, the term of this patent is extended or adjusted under 35 U.S.C. 154(b) by 0 days.

(21) Appl. No.: 16/239,058

(22) Filed: Jan. 3, 2019

(65) Prior Publication Data

US 2020/0215703 A1 Jul. 9, 2020

(51) Int. Cl.
*B26B 5/00* (2006.01)
*B26B 1/08* (2006.01)
*B26B 9/00* (2006.01)

(52) U.S. Cl.
CPC ..... *B26B 5/003* (2013.01); *B26B 1/08* (2013.01); *B26B 9/00* (2013.01)

(58) Field of Classification Search
CPC ..... B26B 5/003; B26B 1/08; B26B 9/00
USPC ..... 30/162
See application file for complete search history.

(56) References Cited

U.S. PATENT DOCUMENTS 3,652,173 A * 3/1972 Miller ..... B43K 24/084 401/110
3,657,812 A * 4/1972 Lee ..... B26B 1/08 30/162
3,885,308 A * 5/1975 Gordin ..... B26B 1/08 30/162
3,892,038 A * 7/1975 Novak ..... B26B 11/00 30/DIG. 3
4,192,066 A * 3/1980 Tucker ..... F41B 13/00 30/162
D263,020 S * 2/1982 Rau, III ..... D8/99
4,337,576 A * 7/1982 Drost ..... A61B 17/3213 30/162
4,601,599 A * 7/1986 Katoh ..... B43K 7/005 401/109
4,663,846 A * 5/1987 Takayama ..... B26B 5/001 30/162
5,292,329 A * 3/1994 Werner ..... A61B 17/3211 30/162

(Continued)

FOREIGN PATENT DOCUMENTS

JP 05168773 A * 7/1993 ..... B26B 3/00

*Primary Examiner* — Jason Daniel Prone
(74) *Attorney, Agent, or Firm* — Ellenoff Grossman & Schole LLP; James M. Smedley; Alex Korona

(57) ABSTRACT

A cutting device is disclosed. The cutting device has a housing assembly, a cutting assembly that is movably disposed in the housing assembly, the cutting assembly being movable in a first axis, between a retracted position and an extended position, and an urging member disposed between the housing assembly and the cutting assembly. The cutting assembly includes a cutting member. The cutting assembly includes an end assembly, which is actuatable in the first axis, and a movable member that is movable relative to the cutting assembly. When the end assembly is actuated, the urging member biases the cutting assembly in the first axis toward the retracted position. When the end assembly is actuated, the end assembly moves the movable member in a second axis that is different from the first axis.

10 Claims, 5 Drawing Sheets

(56) References Cited

U.S. PATENT DOCUMENTS 5,391,177 A * 2/1995 Schwartz ..... A61B 17/3211 30/162
5,768,787 A * 6/1998 Ireland ..... B26B 5/001 30/335
5,813,083 A * 9/1998 Gould ..... A63F 3/068 30/162
5,974,672 A * 11/1999 Hsu ..... B26B 3/00 30/300
6,151,786 A * 11/2000 Hellstern ..... B26B 9/00 30/357
6,219,923 B1 * 4/2001 Sinisi ..... B26B 5/001 30/162
6,474,891 B1 * 11/2002 Liu ..... B43K 8/04 401/174
6,682,212 B2 * 1/2004 Gao ..... B43K 29/10 362/118
8,117,755 B2 * 2/2012 Scimone ..... B26B 9/00 30/151
8,136,251 B2 * 3/2012 Endo ..... A61B 17/3211 30/162
8,943,700 B2 * 2/2015 Cetola ..... A61B 17/3213 30/162
9,364,958 B2 * 6/2016 Scimone ..... B26B 5/003
10,405,685 B2 * 9/2019 Wong ..... A47J 17/02
10,427,310 B2 * 10/2019 Scimone ..... B26B 5/003
2005/0210682 A1 * 9/2005 Bartholin ..... B26B 5/001 30/162
2008/0095568 A1 * 4/2008 Hsien ..... B43K 24/03 401/115
2011/0030226 A1 * 2/2011 Dunn-Rankin ..... B26B 9/00 30/346.53
2014/0182140 A1 * 7/2014 Rosenhan ..... B26B 5/003 30/162
2016/0279812 A1 * 9/2016 Scimone ..... B26B 5/003
2019/0077031 A1 * 3/2019 Gallegos ..... B26B 5/001

* cited by examiner

CUTTING DEVICE

TECHNICAL FIELD

The present disclosure generally relates to a cutting device, and more particularly to a cutting device having a retractable blade.

BACKGROUND

Precision cutting devices are used in many applications and industries. Conventional precision cutting devices typically involve devices that have a constantly exposed blade or that have caps or covers that may be easily misplaced or lost. Precision cutting devices also typically include relatively sharp blades that may pose the potential for accidental cutting of objects, users, or others.

Accordingly, conventional precision cutting devices are often carried, stored, and left unattended with a relatively sharp, exposed blade that may pose the potential for accidents to users and others, as well as accidental damage to property. Further, precision blades themselves, which may be relatively susceptible to damage, may be accidentally deformed or broken based on being in a continuously exposed state. Accordingly, a need for a way for efficiently avoiding inadvertent cutting of objects and users and avoiding loss of easily misplaced caps and covers exists in the art.

The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a housing assembly, a cutting assembly that is movably disposed in the housing assembly, the cutting assembly being movable in a first axis, between a retracted position and an extended position, and an urging member disposed between the housing assembly and the cutting assembly. The cutting assembly also includes a cutting member. The cutting assembly further includes an end assembly, which is actuatable in the first axis, and a movable member that is movable relative to the cutting assembly. When the end assembly is actuated, the urging member biases the cutting assembly in the first axis toward the retracted position. When the end assembly is actuated, the end assembly moves the movable member in a second axis that is different from the first axis.

In another aspect, the present disclosure is directed to a method. The method includes disposing a cutting assembly in a housing assembly, removably attaching a cutting member to the cutting assembly, moving the cutting assembly in the housing assembly in a first direction from a retracted position to an extended position, and moving the cutting assembly in the housing assembly in a second direction from the extended position to the retracted position. The method also includes biasing the cutting assembly in the second direction with an urging force, actuating the cutting assembly in the first direction with an actuating force that is greater than the urging force, and moving a movable member of the cutting assembly in a third direction that is different from the first and second directions.

DETAILED DESCRIPTION AND INDUSTRIAL APPLICABILITY

Figure 1:
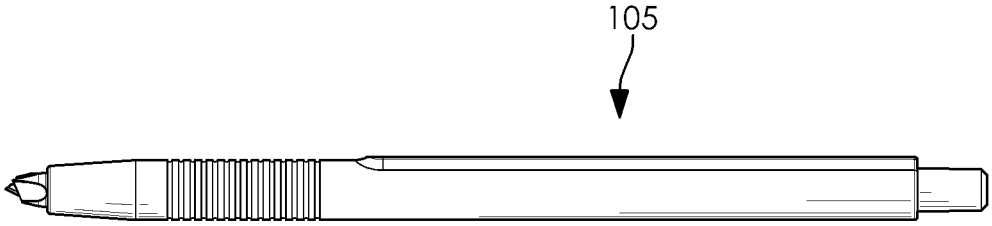
FIG. 1 is a side view of an exemplary cutting device in accordance with an embodiment of the present invention.
Figure 2:
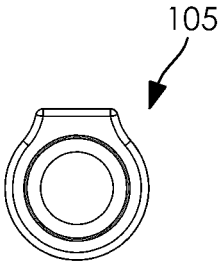
FIG. 2 is a rear view of an exemplary cutting device in accordance with an embodiment of the present invention.
Figure 3:
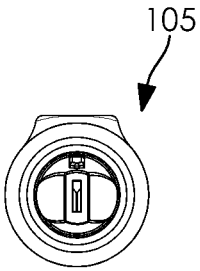
FIG. 3 is a front view of an exemplary cutting device in accordance with an embodiment of the present invention.

FIGS. 1-3 illustrate an exemplary cutting device 105. The exemplary cutting device disclosed herein may be any suitable device for cutting material such as, for example, a cutting device used for precision cutting of material. For example, cutting device 105 may be used for precisely cutting material for use in technical applications such as engineering and manufacturing, artistic or graphic design uses, or any other suitable activity involving precise cutting of objects or materials.

Figure 4:
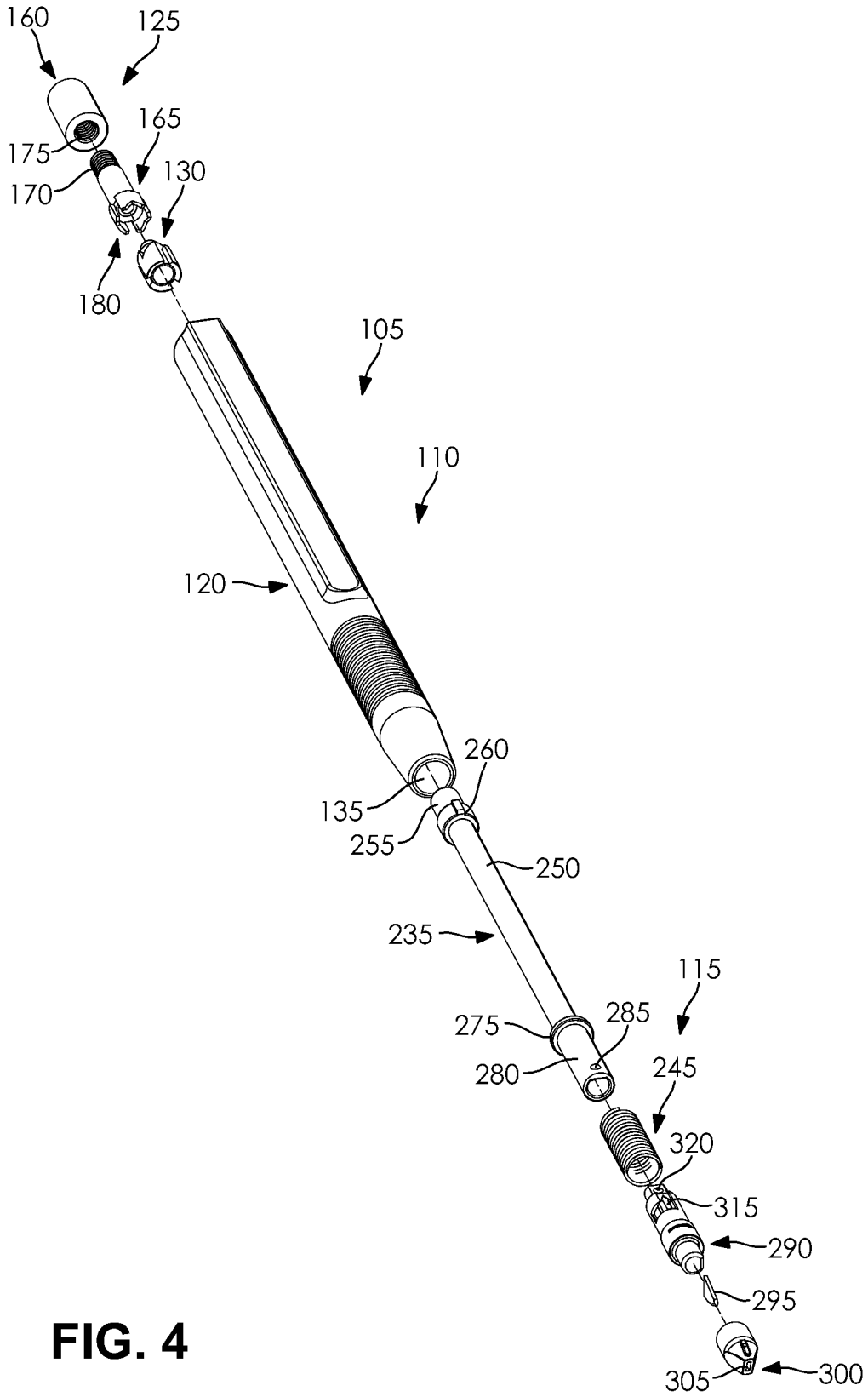
FIG. 4 is a perspective view of an exemplary cutting device in accordance with an embodiment of the present invention.

As illustrated in FIG. 4, cutting device 105 may include a housing assembly 110 and a cutting assembly 115. Cutting assembly 115 may be movably disposed in housing assembly 110 as described for example below.

The exemplary cutting device may be constructed from any suitable variety of durable materials or any other suitable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, housing assembly 110 may be formed partially or substantially entirely from plastic, plastic composite, metal, and/or metal alloy materials. For example, housing assembly 110 may include plastic or metal structural members. Weights may be included in housing assembly 110 and/or cutting assembly 115 to help balance cutting device 105 during use, with the weights being formed for example from metal material. Cutting assembly 115 may include components formed from plastic, plastic composite, metal, metal alloy materials, and/or components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic.

Housing assembly 110 may include a housing 120, an end assembly 125, and a movable member 130. End assembly 125 and movable member 130 may be received in a cavity of housing 120. Movable member 130 may be received within a recess of a portion of end assembly 125 so that movable member 130 is movably disposed within housing 120 as described for example below.

Housing 120 may provide, for example, a gripping surface for cutting device 105 for use by a user. For example, housing 120 may be a substantially hollow housing having a cavity 135 configured to receive and retain other portions of housing assembly 110 and cutting assembly 115. For example, housing 120 may be a cylindrical housing. Also for example, housing 120 may be any other suitable shape such as, for example, a tube shape, a square prism, triangular prism, a hexagonal prism, an octagonal prism, a polygonal prism, and/or any other desired shape (e.g., elongated shape).

As illustrated in FIGS. 5-8, housing 120 may include a wall portion 140 that may form cavity 135 and that may include an exterior surface 145 that users may grip to hold cutting device 105. Wall portion 140 may also include protrusions 150 disposed at exterior surface 145 that may assist a user in gripping cutting device 105 (e.g., during precision cutting). Housing 120 may also include an interior surface 155 forming a surface of cavity 135. As illustrated in FIGS. 5-8, interior surface 155 and cavity 135 may be shaped, dimensioned, and/or formed to retain other components of housing assembly 110 and portions of cutting assembly 115. Housing 120 may include recesses, apertures, cavities, protrusions, and/or any other suitable portions disposed at interior surface 155 that receive corresponding recesses, apertures, cavities, protrusions, and/or any other suitable portions of housing assembly 110 and portions of cutting assembly 115. For example, housing 120 may include elongated recesses disposed at interior surface 155 that receive a protrusion of cutting assembly 115 and thereby provide a track allowing for a predetermined movement of cutting assembly 115 within housing 120. For example, housing 120 may include a substantially straight recess that receives a portion of cutting assembly 115 to allow for a substantially straight movement of cutting assembly 115 as it moves within housing 120. Housing 120 may also include a recess disposed at interior surface 155 that receives a portion of end assembly 125 to allow for a predetermined (e.g., straight) movement of end assembly 125. Also for example, housing 120 may include protrusions disposed at interior surface 155 that are received in recesses disposed at exterior surfaces of other portions of housing assembly 110 or cutting assembly 115. As described herein, housing 120 may thereby retain and guide a movement of cutting assembly 115 and/or other portions of housing assembly 110 (e.g., end assembly 125 and/or movable member 130).

End assembly 125 may include an end member 160 and an actuating member 165. Actuating member 165 may be attached to end member 160 by any suitable technique such as, for example, adhesive, press-fit, snap-fit, threading, and/or any other suitable technique for attachment. For example as illustrated in FIG. 4, actuating member 165 may include threading 170 that may be threaded into threading 175 disposed on an interior surface of a cavity of end member 160.

Figure 9:
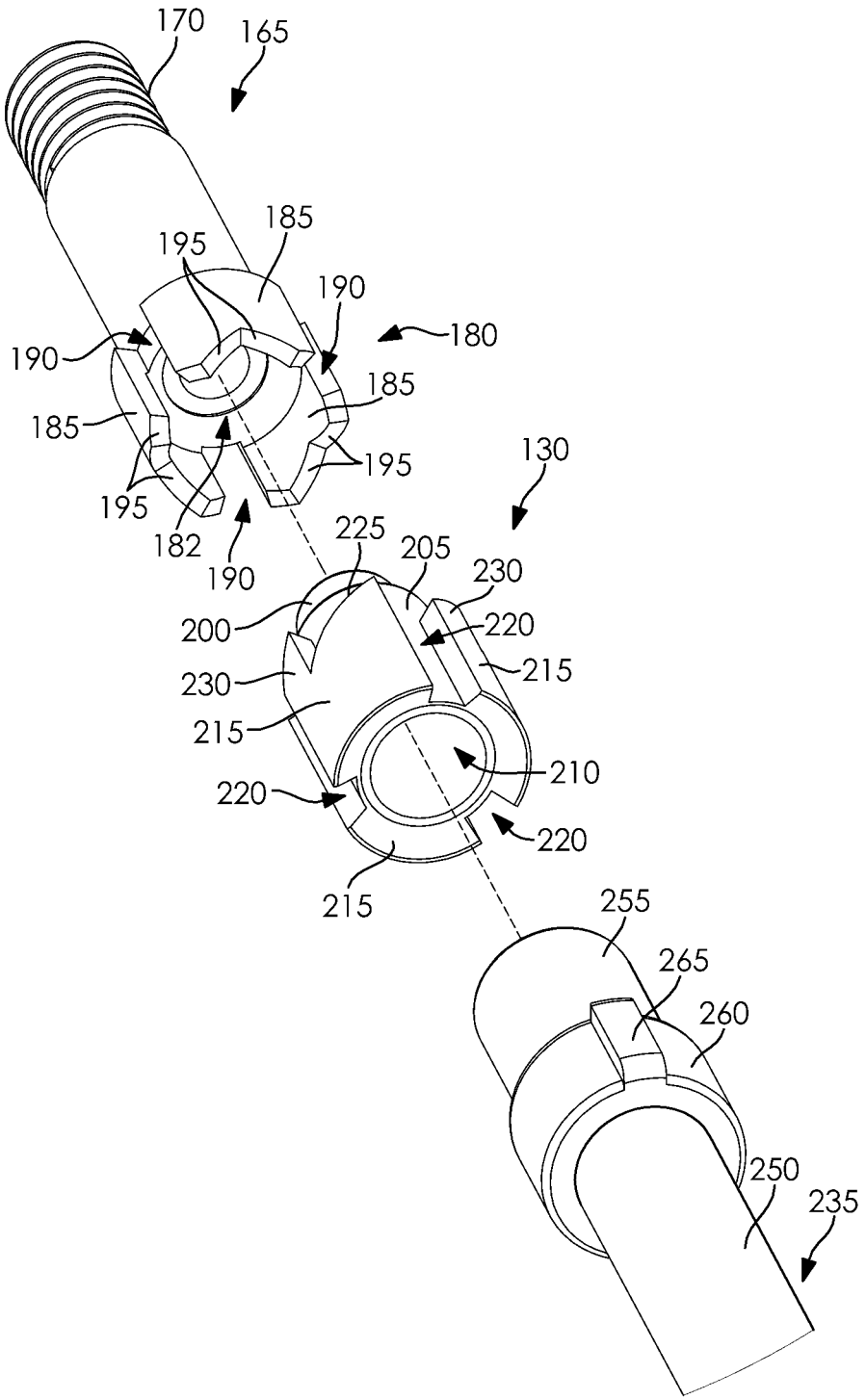
FIG. 9 is a perspective view of components of an exemplary cutting device in accordance with an embodiment of the present invention.

As illustrated in FIG. 9, actuating member 165 may also include a receiving portion 180. Receiving portion 180 may form a cavity 182 configured to receive a portion of movable member 130. Receiving portion 180 may include a plurality of wall portions 185 that are spaced from each via apertures 190. Each wall portion 185 may include a recess (e.g., notch or inwardly-shaped indention) formed by surfaces 195 that may be angled inward. For example, surfaces 195 may form inverted V-shaped recesses in wall portion 185. As described for example below, surfaces 195 of wall portions 185 may be configured to receive portions of movable member 130 to move movable member 130 based on an operation of cutting device 105.

Movable member 130 may include a protrusion 200 configured to be received in cavity 182 of actuating member 165. Movable member 130 may also include a wall portion 205 forming a cavity 210. A plurality of protruding portions 215 may protrude from wall portion 205. Protruding portions 215 may be spaced from each other via a plurality of apertures 220. Each protruding portion 215 may include a surface 225 and a portion 230. Surface 225 may be an angled surface that forms a V-shape with portion 230. For example, surface 225 and portion 230 may form notches or recessed portions that are raised above a surface of wall portion 205. As described for example herein, protruding portions 215 of movable member 130 may engage with and be biased by wall portions 185 of actuating member 165 to move movable member 130 based on an operation of cutting member 105 as described for example below. Also, apertures 190 of actuating member 165 and/or apertures 220 of movable member 130 may be selectively aligned with other portions of housing assembly 110 based on an operation of cutting device 105 as disclosed for example below.

As illustrated in FIGS. 4-8, cutting assembly 115 may include a body member 235, a blade assembly 240, and an urging member 245. Blade assembly 240 may be attached to body member 235, and urging member 245 may be disposed at an end portion of body member 235 at which blade assembly 240 may be attached. Cutting assembly 115 may be movably disposed within cavity 135 of housing 120 as disclosed for example herein.

Figure 7:
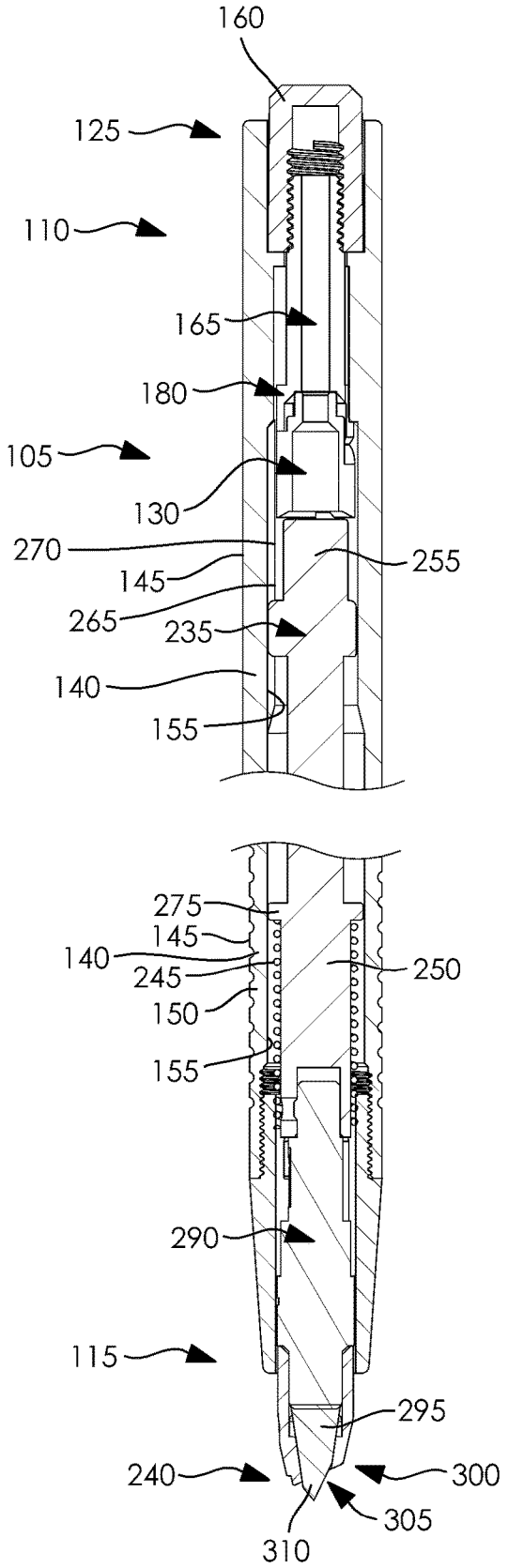
FIG. 7 is a sectional view of an exemplary cutting device in accordance with an embodiment of the present invention.
Figure 8:
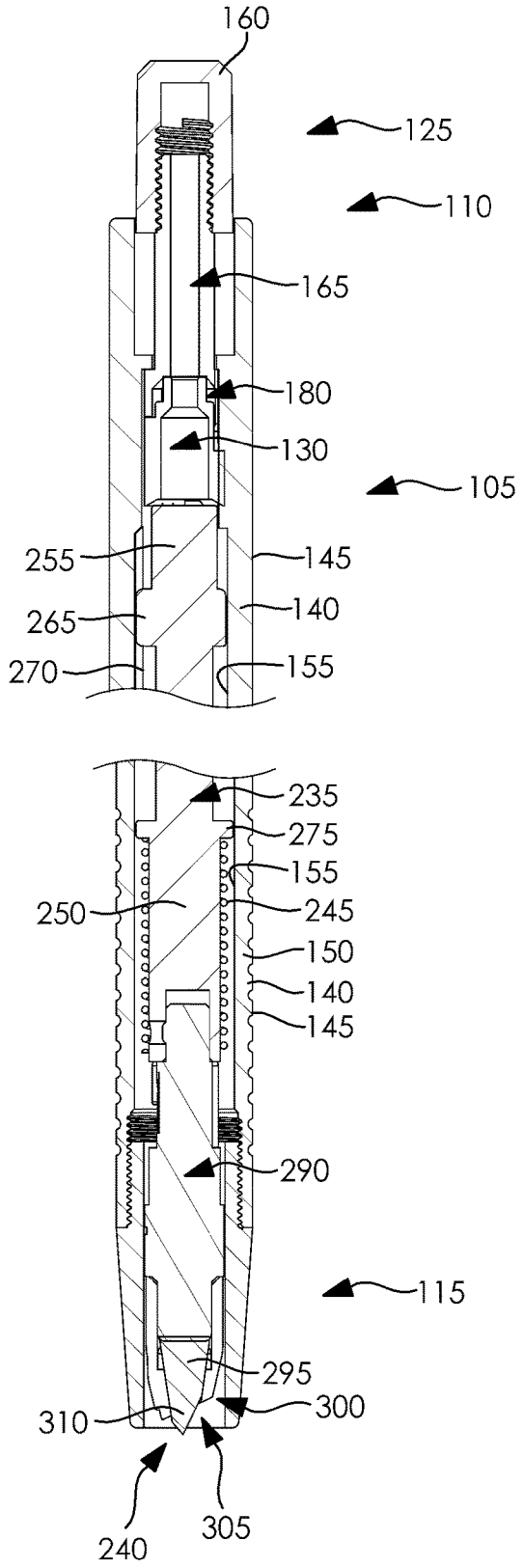
FIG. 8 is a sectional view of an exemplary cutting device in accordance with an embodiment of the present invention.

Body member 235 may include a shaft portion 250 that extends along a longitudinal direction of cutting device 105. For example, shaft portion 250 may extend along a longitudinal direction of cavity 135 of housing 120. Shaft portion 250 may include an end portion 255 that may abut against a rear portion of wall portion 205 and/or protruding portion 215 of movable member 130. As illustrated in FIG. 9, wall portion 205 and/or protruding portion 215 may for example form a small recess to receive a portion of end portion 255. A protruding portion 260 may be disposed on shaft portion 250 near end portion 255. Protruding portion 260 may be for example an annular portion such as an annular ring portion. As illustrated in FIGS. 5-8, protruding portion 260 may be sized to fit within cavity 135 so that protruding portion 260 fits within one or more portions of interior surface 155 to help guide a movement (e.g., a substantially straight movement) of cutting assembly 115 within housing 120. As illustrated in FIGS. 7-9, a protrusion 265 may protrude from an exterior portion of protruding portion 260. As illustrated in FIGS. 7 and 8, protrusion 265 may be received in a recess 270 of housing 120. Recess 270 may be an elongated recess that may guide a movement of protrusion 265 and cutting assembly 115. For example, recess 270 may be a substantially straight, elongated recess that receives protrusion 265 to provide for a substantially straight movement of body member 235 and cutting assembly 115 as cutting assembly 115 moves within housing 120.

As illustrated in FIGS. 4, 7, and 8, body member 235 may also include a protruding portion 275 disposed at an end portion 280 of shaft portion 250. Protruding portion 275 may be for example an annular portion such as an annular ring portion. Protruding portion 275 may be sized to fit within cavity 135 so that protruding portion 275 fits within one or more portions of interior surface 155 to help guide a substantially straight movement of cutting assembly 115 within cavity 135 of housing 120. Protruding portion 275 may also serve as an attachment point and/or retaining portion to help maintain urging member 245 in a desired position on cutting assembly 115. As illustrated in FIG. 4, body member 235 may also include an aperture 285 disposed at end portion 280. Aperture 285 may receive a portion of blade assembly 240 to help maintain an attachment between blade assembly 240 and body member 235.

Figure 5:
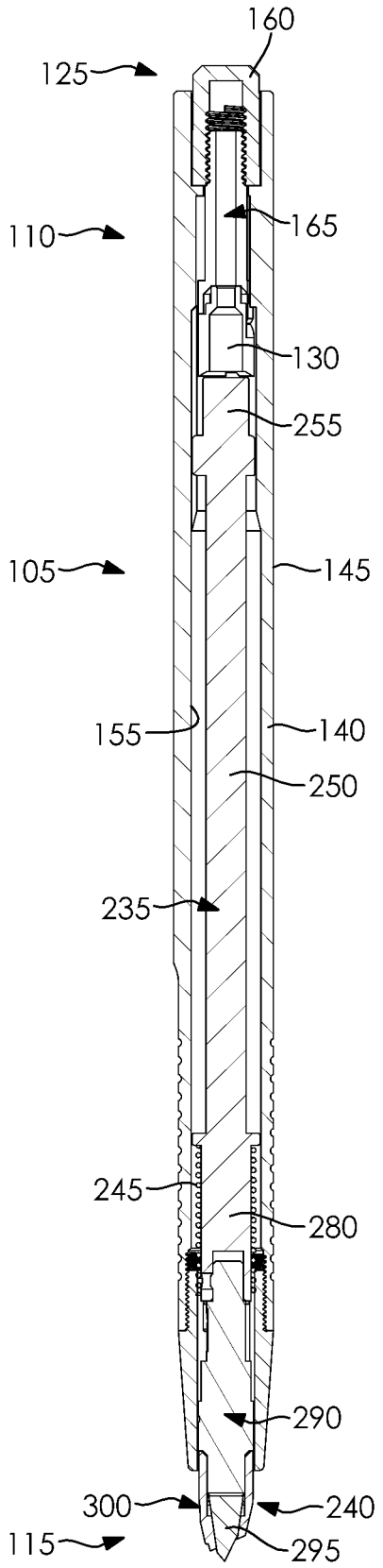
FIG. 5 is a sectional view of an exemplary cutting device in accordance with an embodiment of the present invention.
Figure 6:
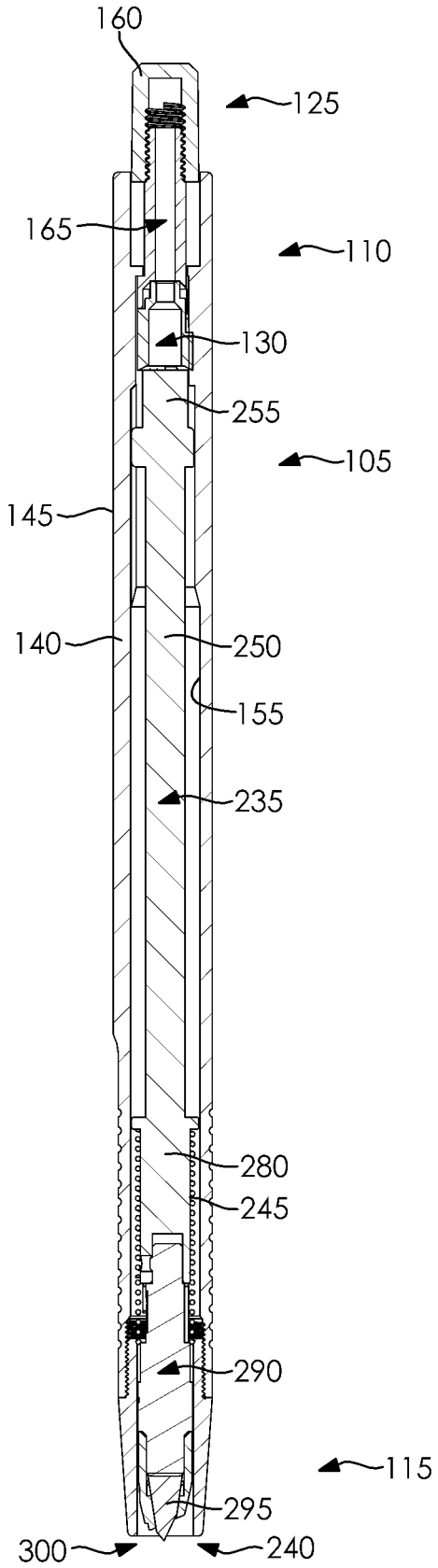
FIG. 6 is a sectional view of an exemplary cutting device in accordance with an embodiment of the present invention.

As illustrated in FIGS. 4-6, blade assembly 240 may include a blade retaining member 290, a cutting member 295, and a cover member 300. Cutting member 295 may be retained on blade retaining member 290 based on an attachment of cover member 300 to blade retaining member 290. Cover member 300 may include an aperture 305. Cutting member 295 may be received in a cavity of cover member 300, with a cutting portion 310 extending through aperture 305 as illustrated in FIGS. 7 and 8. Cover member 300 may be attached to blade retaining member 290 so that cutting member 295 is retained and attached to cutting assembly 115. Cover member 300 may be removably attachable to blade retaining member 290 so that cutting member 295 may be removed and replaced as desired. Cover member 300 may be removably attachable to blade retaining member 290 by any suitable technique such as, for example, snap-fitting, press-fitting, threading, and/or any other desired technique for attachment. As illustrated in FIG. 4, blade retaining member 290 may include a recess 315 that may receive a portion (e.g., a protrusion) disposed on an interior surface of housing 120 to help attach blade retaining member 290 to body member 235. Blade retaining member 290 may also include a protrusion 320 that may be received in aperture 285 of body member 235 to removably attach blade retaining member 290 to body member 235. It is also contemplated that blade assembly 240 may be attached in a fixed manner to body member 235.

Cutting member 295 may be any suitable blade or cutter for cutting of a material by cutting device 105. For example, cutting member 295 may be formed from a ceramic material that is capable of withstanding extended use before becoming dull or unusable. Cutting member 295 may be any suitable blade for precision cutting. For example, cutting member 295 may be a ceramic blade. For example, cutting member 295 may include ceramic materials such as Zirconium Oxide or any other suitable ceramic materials for use in a blade. For example, cutting member 295 may be a ceramic blade that may be an angled or hooked blade formed from Zirconium Oxide. Alternatively for example, cutting member 295 may be a metal blade or a blade formed from any suitable material than can be used for cutting materials. Cutting member 295 may include rounded tips to reduce the chance of a user being cut unintentionally by cutting member 295.

Urging member 245 may be attached in a fixed manner or removably attachable at end portion 280 of body member 235. For example, urging member 245 may be attached at protruding portion 275 of body member 235 and may extend to a portion of blade retaining member 290. Urging member 245 may also be attached to interior surface 155 of housing 120. For example, a first end portion of urging member 245 may be attached to (e.g., or retained by) body member 235 and a second end portion of urging member 245 may be attached to (e.g., or retained by) housing 120 so that urging member 245 may compress and stretch based on a movement of body member 235 and cutting assembly 115 relative to housing 120 and housing assembly 110. Urging member 245 may apply an urging force that urges blade assembly 240 to move from an extended position to a retracted position within cavity 135 of housing 120 based on a movement of cutting assembly 115 as described for example below.

Urging member 245 may be a potential-energy-storing member. Urging member 245 may be any suitable member that may be for example stretched and unstretched and/or compressed and uncompressed. Urging member 245 may be urged or biased between a neutral or unbiased state (e.g., storing substantially no potential energy) and a biased state (e.g., storing potential energy). Urging member 245 may be, for example, a tension member or a compression member. For example, urging member 245 may be a spring having a plurality of coils. Urging member 245 may also be an elastic member or elastic band, a cable, a wire, and/or a member formed from materials having elastic or resilient properties and capable of being stretched and unstretched (e.g., or compressed and uncompressed). Urging member 245 may be formed from any suitable materials for forming a tension member or a compression member (e.g., that can be stretched and unstretched, or compressed and uncompressed) such as metallic material, plastic material, composite material, elastomeric material, natural rubber, and/or synthetic rubber. For example, urging member 245 may be a metallic, plastic, or composite spring. Also for example, urging member 245 may be a rubber band or an elastomeric cable, wire, or cord.

In at least some exemplary embodiments, an exemplary cutting device (e.g., cutting device 105) may include a housing assembly (e.g., housing assembly 110), a cutting assembly (e.g., cutting assembly 115) that is movably disposed in the housing assembly, the cutting assembly being movable in a first axis, between a retracted position and an extended position, and an urging member (e.g., urging member 245) that attaches the housing assembly to the cutting assembly. The cutting assembly may include a cutting member (e.g., cutting member 295). The cutting assembly may include an end assembly (e.g., end assembly 125), which may be actuatable in the first axis, and a movable member (e.g., movable member 130) that may be movable relative to the cutting assembly. When the end assembly is actuated, the urging member may bias the cutting assembly in the first axis toward the retracted position. When the end assembly is actuated, the end assembly may move the movable member in a second axis that is different from the first axis. The movable member may be a rotatable member. When the cutting assembly is in the retracted position, the cutting member may be disposed substantially entirely within the housing assembly. The end assembly may include a plurality of first angled surfaces (e.g., surfaces 195) that bear against a plurality of second angled surfaces (e.g., surfaces 225) of the movable member, and the first angled surfaces may slide relative to the second angled surfaces when the end assembly is actuated. The second axis may be substantially perpendicular to the first axis. The cutting assembly may include a protrusion (e.g., protrusion 265) that is received in an elongated recess (e.g., recess 270) disposed in an interior surface portion of the housing assembly. The elongated recess may be a substantially straight groove that is disposed substantially parallel to the first axis. The cutting member may be a ceramic blade. The cutting member may be removable. The urging member may be a spring.

In at least some exemplary embodiments, the exemplary cutting device (e.g., cutting device 105) may include a housing assembly (e.g., housing assembly 110), a cutting assembly (e.g., cutting assembly 115) that may be movably disposed in the housing assembly, the cutting assembly being movable in a first direction from a retracted position to an extended position, and in a second direction from the extended position to the retracted position, and a spring that may attach the housing assembly to the cutting assembly. The cutting assembly may include a ceramic blade. The cutting assembly may also include an end assembly, which may be actuatable in the first and second directions, and a rotatable member that may be rotatable relative to the cutting assembly. When the end assembly is actuated in the first direction, the spring may bias the cutting assembly in the second direction. When the end assembly is actuated in the first direction, the end assembly may rotate the rotatable member about a rotatable axis that is parallel to the first and second directions. When the cutting assembly is in the retracted position, the ceramic blade may be disposed substantially entirely within the housing assembly. The end assembly may include a plurality of first angled surfaces (e.g., surfaces 195) that bear against a plurality of second angled surfaces (e.g., surfaces 225) of the rotatable member, and the first angled surfaces may slide relative to the second angled surfaces when the end assembly is actuated in the first direction. The end assembly may include a plurality of apertures (e.g., apertures 190) that selectively align with a plurality of portions (e.g., portions 230) of the rotatable member based on a rotation of the rotatable member. When the cutting assembly is in the retracted position, the plurality of portions of the rotatable member may be received in the plurality of recesses of the end assembly. The cutting assembly may include a body member (e.g., body member 235) that is non-rotatable relative to the housing assembly, the end assembly may be non-rotatable relative to the housing assembly, and the rotatable member may be rotatable relative to the housing assembly.

The exemplary cutting device disclosed herein may be any suitable device for cutting material such as, for example, a cutting device used for precision cutting of material. For example, the exemplary cutting device may be any suitable cutting device for precisely cutting material for use in technical applications such as engineering and manufacturing, artistic or graphic design, construction, or any other suitable activity involving precise cutting of objects or materials.

An exemplary operation of cutting device 105 will now be described. As illustrated in FIG. 6, cutting device 105 may be stored, carried, or transported for example in a retracted position in which blade assembly 240 of cutting assembly 115 is substantially fully retracted within cavity 135 of housing 120. In the retracted position as illustrated for example in FIG. 8, end assembly 125 may extend out from cavity 135 of housing 120 (e.g., from an end portion of housing 120 that is distal from an end portion from which blade assembly 240 may extend). In the retracted position, urging member 245 may be in a neutral or unbiased state (e.g., storing substantially no potential energy). For example, urging member 245 may be an uncompressed spring in a neutral state when cutting device 105 is in the retracted position. It is also contemplated that urging member 245 may be in a biased state and/or may be a spring in a compressed state when cutting device 105 is in the retracted position.

A user may change (e.g., switch) cutting device 105 from the retracted position to an extended position. The user may press on end member 160 to urge end assembly 125 into cavity 135 of housing 120. Cutting device 105 may thereby move from the exemplary retracted position illustrated in FIG. 8 to the exemplary extended position illustrated in FIG. 7. As illustrated in FIG. 7, the user may move end member 160 into cavity 135 so that it is seated on a portion of housing 120, thereby moving end member 160 and actuating member 165 toward a central portion of cavity 135. As actuating member 165 is moved, it may exert an actuating force on movable member 130. Movable member 130 may thereby apply an actuating force to body member 235, which may apply an actuating force to urging member 245. Based on the actuating force of the user pressing on end member 160, the entire cutting assembly 115 may be moved within housing 120. Blade assembly 240 may thereby be extended from cavity 135 of housing 120, causing cutting member 295 to emerge from a front portion of cavity 135 as illustrated in FIG. 7. As cutting device 105 moves from the retracted position illustrated in FIG. 8 to the extended position illustrated in FIG. 7, urging member 245 may move from an uncompressed (e.g., neutral) unbiased state to a compressed biased state, thereby storing an increasing amount of potential energy. It is also contemplated that urging member 245 may move to an uncompressed state when cutting device 105 is in the extended position.

As cutting device 105 moves from the retracted position to the extended position and cutting assembly 115 actuates (e.g., compresses) urging member 245, actuating member 165 bears against movable member 130. In the retracted position, portions 230 of movable member 130 may be received in apertures 190 of actuating member 165. Surfaces 225 of movable member 130 may bear against surfaces 195 of actuating member 165. As the user presses end member 160 and moves cutting device 105 from the retracted position to the extended position, surfaces 225 of movable member 130 may bear and urge against surfaces 195 of actuating member 165, causing portions 230 of movable member 130 to move out of apertures 190 of actuating member 165. Once portions 230 of movable member 130 have been completely removed from apertures 190 of actuating member 165, angled surfaces 225 of movable member 130 may slide relative to surfaces 195 of actuating member 165. For example, an urging action (e.g., cam action) may result based on surfaces 225 sliding relative to surfaces 195, causing movable member 130 to rotate relative to actuating member 165 and body member 235.

Portions 230 may slide along surfaces 195 and be received in the V-shaped recesses or notches formed between adjacent surfaces 195. At this point, cutting device 105 may be in the extended position illustrated in FIG. 7. The user may release end member 160, and cutting assembly 115 may remain in the extended position based on portions 230 of movable member 130 being retained in the recesses or notches formed by adjacent surfaces 195 of actuating member 165. Urging member 245, which may be in a biased (e.g., compressed) state storing potential energy, may apply an urging force that helps to maintain portions 230 in recesses or notches formed by adjacent surfaces 195. End member 160 and cutting assembly 115 may retract slightly to the position shown in FIG. 1 when the user releases end member 160. Cutting device 105 may be maintained in the extended position as described above (e.g., by urging member 245 applying an urging force that helps to maintain portions 230 in recesses or notches formed by adjacent surfaces 195) after the user releases end member 160. The user may then use cutting device 105 maintained as described above in the extended position as desired.

When the user is finished with a cutting operation and desires to for example, transport, store, or carry cutting device 105, the user may change (e.g., switch) cutting device 105 from the extended position back to the retracted position. The user may press on end member 160 to urge end assembly 125 into cavity 135 of housing 120. The user may apply an actuating force on end member 160 that is greater than the urging force of urging member 245, thereby causing the entire cutting assembly 115 to be moved within housing 120. As the user presses end member 160, surfaces 195 of actuating member 165 push against portions 230 of movable member 130. For example, a sliding action (e.g., cam action) may result based on surfaces 195 sliding relative to portions 230, causing movable member 130 to rotate relative to actuating member 165 and body member 235. Portions 230 may slide along (e.g., up along) surfaces 195 so that portions 230 are removed from recesses or notches formed by adjacent surfaces 195. Portions 230 may thereby be pushed toward apertures 190 of actuating member 165. Once portions 230 of movable member 130 are substantially aligned with apertures 190 of actuating member 165, substantially no surfaces of movable member 130 and actuating member 165 may be bearing against each other (e.g., notwithstanding that the user may still be pushing on end member 160). The biasing or urging force of urging member 245 may then push movable member 130 toward actuating member 165 so that portions 230 are pushed into apertures 190. The entire cutting assembly 115 may thereby be moved within cavity 135 of housing 120 based on urging by urging member 245. Cutting device may thereby be moved from an exemplary extended position as illustrated in FIG. 1 to an exemplary retracted position as illustrated in FIG. 6. The user may then for example carry, store, or transport cutting device 105 as desired. Cutting device 105 may be changed (e.g., switched) between the retracted position and the extended position as desired as described above.

The user may also replace worn or dull cutting members 295 with cutting members 295 as desired. For example, when cutting device 105 is in the extended position, the user may remove portions of cutting device 105 to replace cutting member 295. The user may for example remove (e.g., unsnap, unscrew, or make any other suitable detachment) cover member 300 to uncover blade retaining member 290. The user may then replace cutting member 295 and reattach cover member 300.

Alternatively for example, when cutting device 105 is in the retracted position and urging member 245 is in the unbiased or neutral position in which substantially no potential energy is stored, the user may remove additional portions of cutting device 105 to replace cutting member 295. For example, the user may remove a removably attachable portion of housing 120 to access blade assembly 240. The user may remove cover member 300 and remove blade retaining member 290 from body member 235 and/or housing 120. For example, the user may twist blade retaining member 290 to disengage and remove it from body member 235 and/or housing 120. The user may then replace cutting member 295 on detached blade retaining member 290, reattach blade retaining member 290 to body member 235 and/or housing 120, and reattach cover member 300 (e.g., and/or a removable portion of housing 120). The user may also remove and replace an existing blade retaining member 290 with a new blade retaining member 290. For example, blade retaining member 290 may be a removable and/or replaceable cartridge. It is also contemplated that blade retaining member 290 may be removably attached to a plurality of different cutting devices Any suitable mechanical configuration of housing assembly 110 and/or cutting assembly 115 may be used to facilitate blade change of cutting member 295.

The exemplary method may include providing a cutting assembly (e.g., cutting assembly 115) in a housing assembly (e.g., housing assembly 110), removably attaching a cutting member (e.g., cutting member 295) to the cutting assembly, moving the cutting assembly in the housing assembly in a first direction from a retracted position to an extended position, and moving the cutting assembly in the housing assembly in a second direction from the extended position to the retracted position. The exemplary method may also include biasing the cutting assembly in the second direction with an urging force, actuating the cutting assembly in the first direction with an actuating force that is greater than the urging force, and moving a movable member (e.g., movable member 130) of the cutting assembly in a third direction that is different from the first and second directions. When the cutting assembly is in the retracted position and the cutting member is attached to the cutting assembly, the cutting member may be disposed substantially entirely within the housing assembly. The first and second directions may be substantially parallel to a longitudinal axis of the cutting assembly and a longitudinal axis of the cutting member. The third direction may be a rotational direction about the longitudinal axis of the cutting assembly and the longitudinal axis of the cutting member.

The exemplary disclosed device and method may provide an intuitively simple and safe technique for using a cutting device for the precision cutting of materials. The exemplary disclosed device and method may provide a quick and efficient way to change between a mode in which a blade is exposed and a mode in which a blade is safely covered or retracted. The exemplary disclosed device and method may also provide a technique for avoiding loss or misplacement of blade covers and avoiding accidental cutting by or damage to cutting members.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a housing assembly including a housing defining a longitudinal axis of the cutting device;

a cutting assembly that is movably disposed in the housing, the cutting assembly being movable in a direction defined by the longitudinal axis, between a retracted position and an extended position relative to the housing; and an urging member disposed between the housing assembly and the cutting assembly;

wherein the cutting assembly includes a cutting member;

wherein the housing assembly includes an end assembly, which is actuatable in the direction of the longitudinal axis, and a movable member that is movable relative to the end assembly and the cutting assembly, the movable member disposed between the end assembly and the cutting assembly and engaging both the end assembly and the cutting assembly;

wherein when the end assembly is actuated, the urging member biases the cutting assembly in the direction of the longitudinal axis toward the retracted position;

wherein when the end assembly is actuated, the end assembly rotates the movable member about the longitudinal axis; and wherein the cutting assembly includes both an end portion, which is rotatably received by a wall portion of the movable member, and a protruding portion that protrudes from the cutting assembly, the end portion being disposed between the wall portion and the protruding portion.

2. The cutting device of claim 1, wherein the movable member is a rotatable member.

3. The cutting device of claim 1, wherein when the cutting assembly is in the retracted position, the cutting member is disposed substantially entirely within the housing assembly.

4. The cutting device of claim 1, wherein the end assembly includes a plurality of first angled surfaces that bear against a plurality of second angled surfaces of the movable member, and the first angled surfaces slide relative to the second angled surfaces when the end assembly is actuated.

5. The cutting device of claim 1, wherein the protruding portion includes a protrusion that is received in an elongated recess disposed in an interior surface portion of the housing.

6. The cutting device of claim 5, wherein the elongated recess is a substantially straight groove that is disposed substantially parallel to the longitudinal axis.

7. The cutting device of claim 1, wherein the cutting member is a ceramic blade.

8. The cutting device of claim 1, wherein the urging member is a spring.

9. The cutting device of claim 1, wherein the wall portion forms a cavity in the movable member.

10. The cutting device of claim 1, wherein the wall portion includes a recess that rotatably receives the end portion.

* * * * *